US008164010B2

(12) United States Patent
Zhou et al.

(10) Patent No.: US 8,164,010 B2
(45) Date of Patent: Apr. 24, 2012

(54) CABLE ASSEMBLY WITH SWITCH DEVICE

(75) Inventors: Yi Zhou, Shenzhen (CN); Xian-Kui Shi, Shenzhen (CN); Chung-Yen Yang, Tu-Cheng (TW)

(73) Assignee: Hon Hai Precision Ind. Co, Ltd., New Taipei (TW)

( * ) Notice: Subject to any disclaimer, the term of this patent is extended or adjusted under 35 U.S.C. 154(b) by 28 days.

(21) Appl. No.: 12/701,617

(22) Filed: Feb. 8, 2010

(65) Prior Publication Data

US 2010/0206702 A1 Aug. 19, 2010

(51) Int. Cl.
*H01R 24/00* (2011.01)

(52) U.S. Cl. ..... 200/51.02

(58) Field of Classification Search ..... 439/188, 439/540.1; 200/51.02, 345, 534
See application file for complete search history.

(56) References Cited

U.S. PATENT DOCUMENTS

| | | | | |
|---|---|---|---|---|
| 2,572,335 | A * | 10/1951 | Hafke | 200/303 |
| 2,805,294 | A * | 9/1957 | Edmunds | 200/51 R |
| 2,941,164 | A * | 6/1960 | Lanctot | 333/105 |
| 3,378,664 | A * | 4/1968 | Russenberger | 200/529 |
| 4,055,736 | A * | 10/1977 | Congelliere | 200/16 A |
| 4,317,015 | A * | 2/1982 | Buttner et al. | 200/526 |
| 4,467,160 | A * | 8/1984 | Murmann et al. | 200/536 |
| 4,906,808 | A * | 3/1990 | Burgess et al. | 200/527 |
| 5,008,505 | A * | 4/1991 | Takano et al. | 200/531 |
| 5,092,785 | A * | 3/1992 | Chen | 439/188 |
| 5,145,059 | A * | 9/1992 | Park | 200/527 |
| 5,295,846 | A * | 3/1994 | Sumida et al. | 439/188 |
| 5,350,310 | A * | 9/1994 | Chen | 439/188 |
| 5,819,912 | A * | 10/1998 | Hou | 200/51.02 |
| 6,750,410 | B2 * | 6/2004 | Lee | 200/51.03 |
| 7,118,414 | B2 * | 10/2006 | Spears et al. | 439/540.1 |
| 7,503,802 | B2 * | 3/2009 | Tu et al. | 439/540.1 |
| 7,922,542 | B1 * | 4/2011 | Shu et al. | 439/668 |
| 2002/0195324 | A1 * | 12/2002 | Lee | 200/51.03 |

FOREIGN PATENT DOCUMENTS

| | | |
|---|---|---|
| CN | 2105095 U | 5/1992 |
| CN | 201112847 Y | 9/2008 |

* cited by examiner

*Primary Examiner* — Briggitte R Hammond
(74) *Attorney, Agent, or Firm* — Wei Te Chung; Andrew C. Cheng; Ming Chieh Chang

(57) ABSTRACT

A cable assembly (100) comprises a cover (2) having a plurality of retaining slots (216, 226) arranged in a row along a transversal direction; a number of connectors (12, 13, 14, 15) mounted to the retaining slots, respectively; and a switch device (4) mounted to the cover, the switch including a base portion (41), a pushing portion (42) and an operating portion (43) assembled together in serial manner.

11 Claims, 7 Drawing Sheets

CABLE ASSEMBLY WITH SWITCH DEVICE

BACKGROUND OF THE INVENTION

1. Field of the Invention

The present invention generally relates to cable assembly, and more particularly to a cable assembly having a switch device.

2. Description of Related Art

Nowadays, in order to save assembling time and reduce cost, a computer manufacturer commonly requires cable assembly providers to assemble some input/output ports, such as USB, Video, RCA and IEEE1394 connectors into a module structure, and the module structure may be easily mounted to a computer external cage. However, in most of the computers, a switch device used for computer warm boot system is separately mounted to the computer external cage. Therefore, it may take extra time to assemble the switch device to the computer external cage.

Hence, an improved cable assembly is highly desired to overcome the disadvantages of the related art.

SUMMARY OF THE INVENTION

Accordingly, an object of the present invention is to provide a cable assembly with a switch device.

In order to achieve the object set forth, a cable assembly in accordance with the present invention comprises a cover having a plurality of retaining slots arranged in a row along a transversal direction; a number of connectors mounted to the retaining slots, respectively; and a switch device mounted to the cover, the switch device including a base portion, a pushing portion and an operating portion assembled together in serial manner.

Other objects, advantages and novel features of the invention will become more apparent from the following detailed description when taken in conjunction with the accompanying drawings.

DETAILED DESCRIPTION OF THE INVENTION

Figure 1:
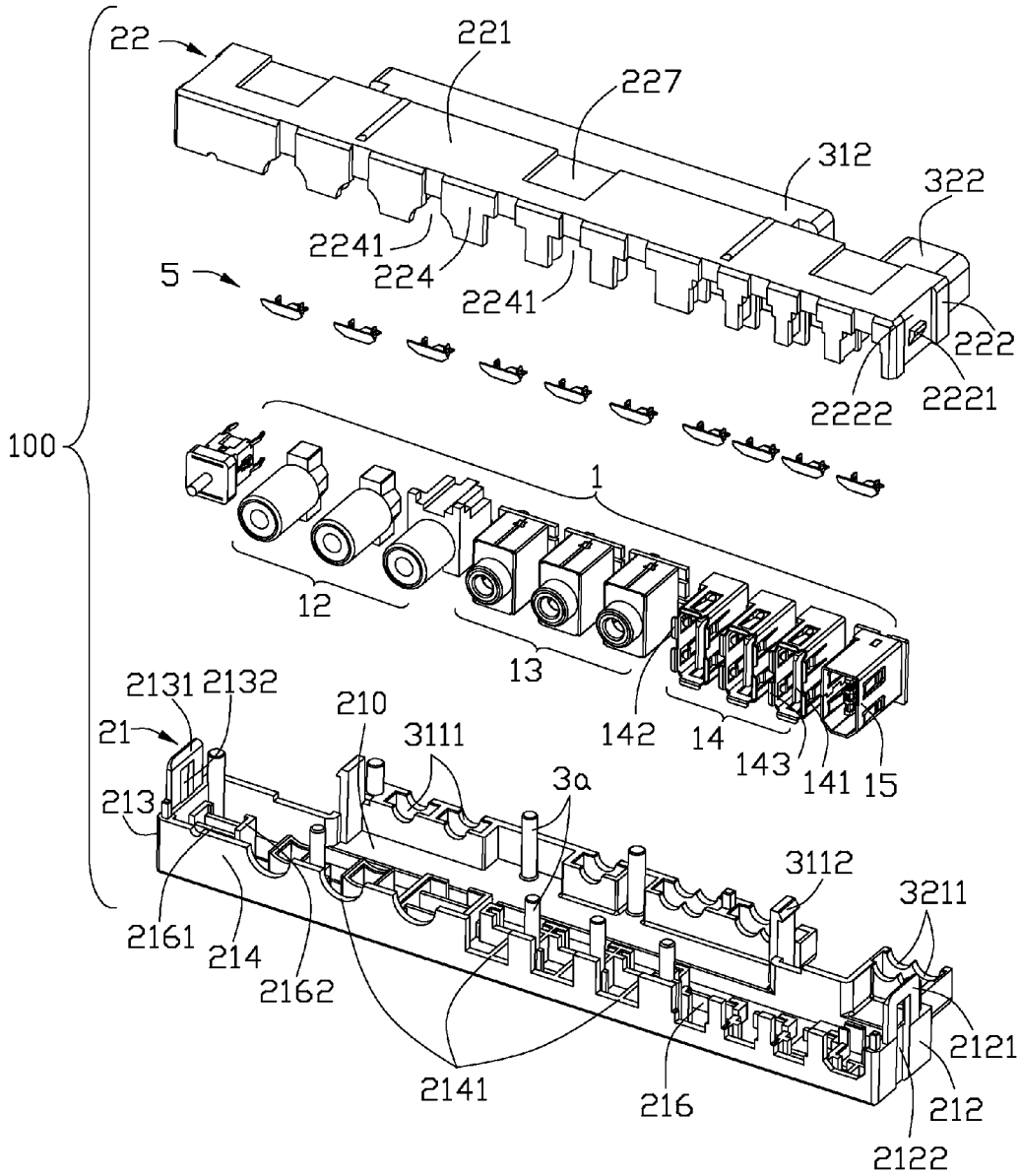
FIG. 1 is an exploded, perspective view of a cable assembly.
Figure 2:
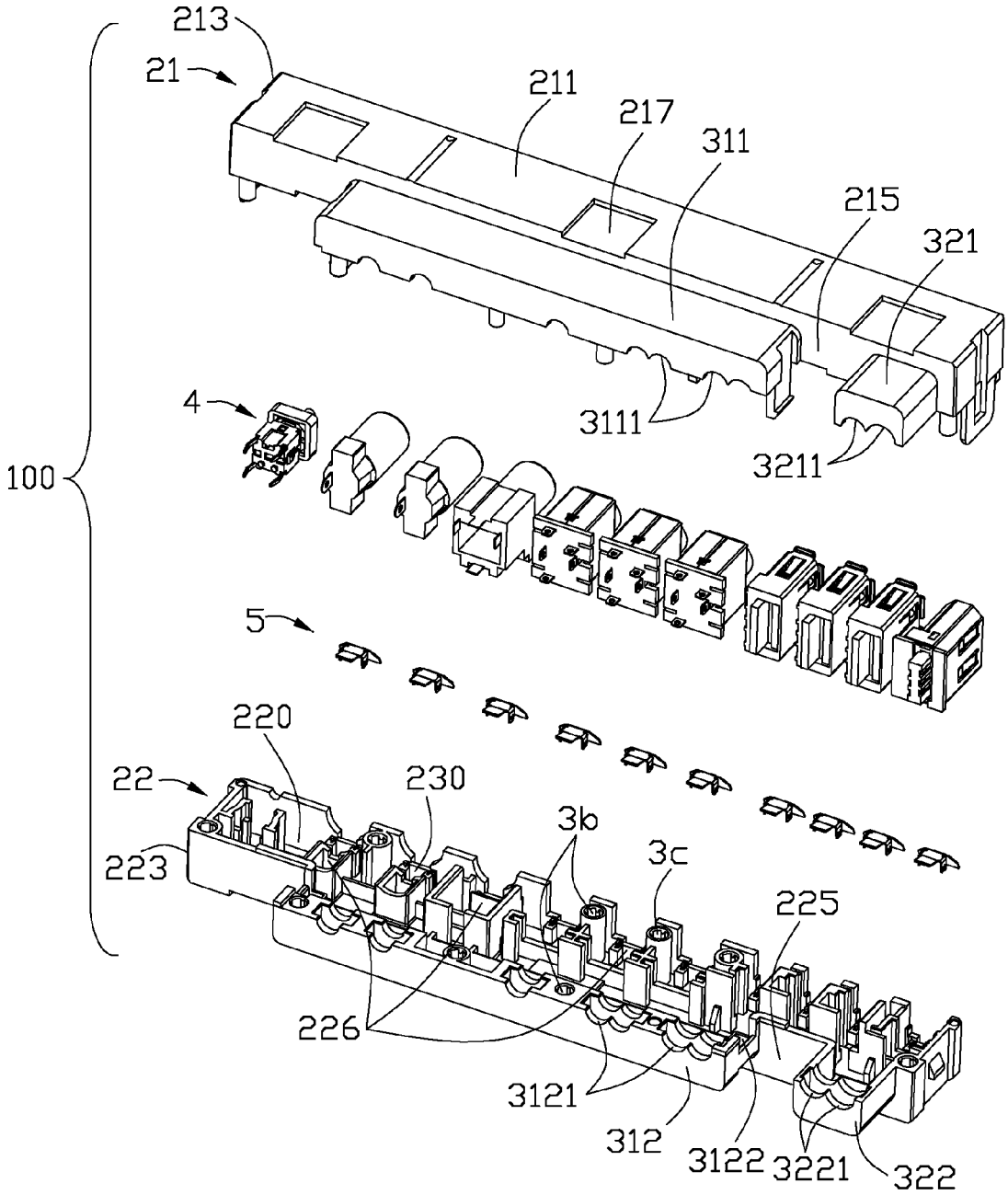
FIG. 2 is a view similar to FIG. 2, but viewed from another aspect.
Figure 3:
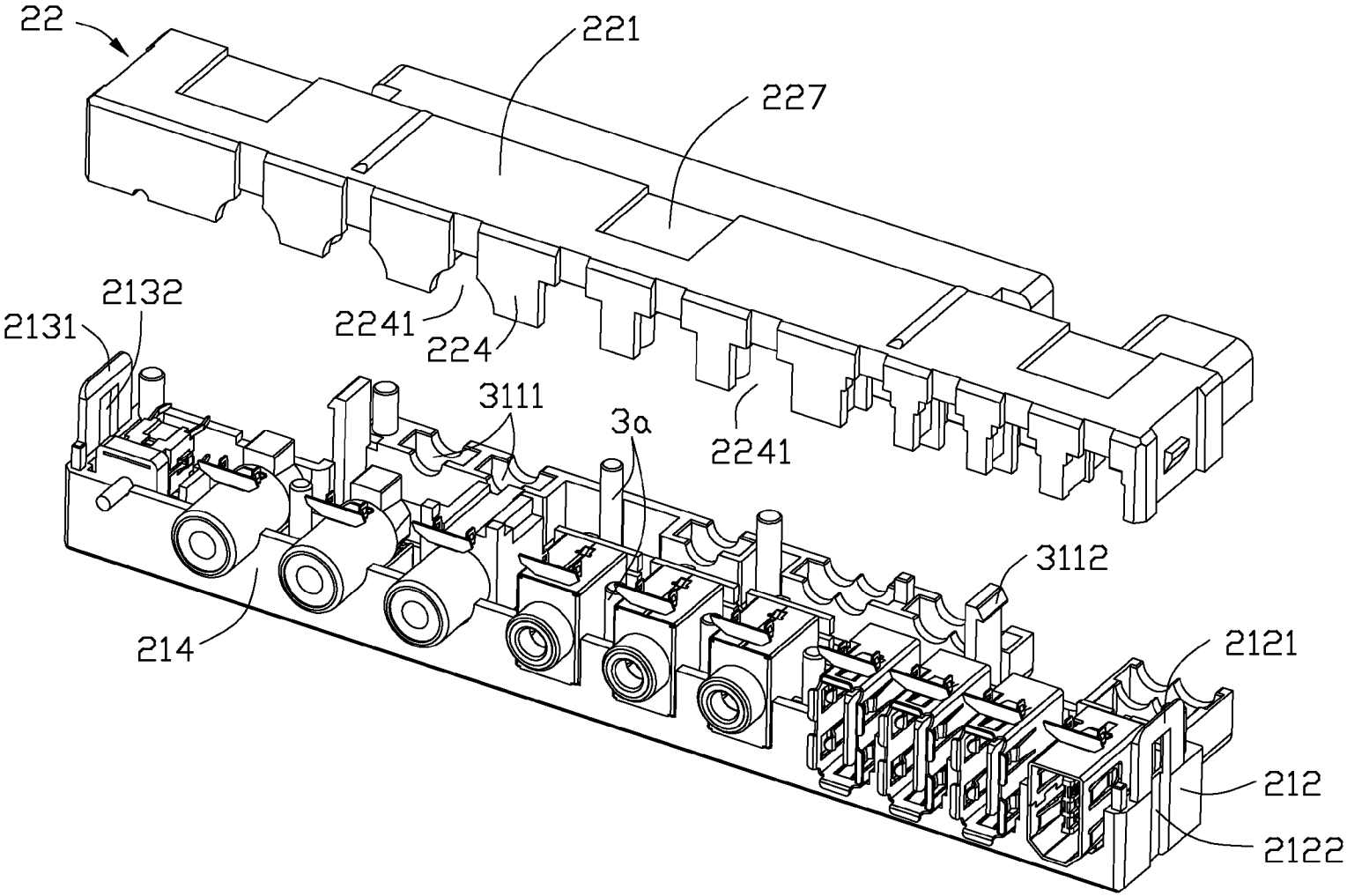
FIG. 3 is a partially assembled, perspective view of the cable assembly.
Figure 4:
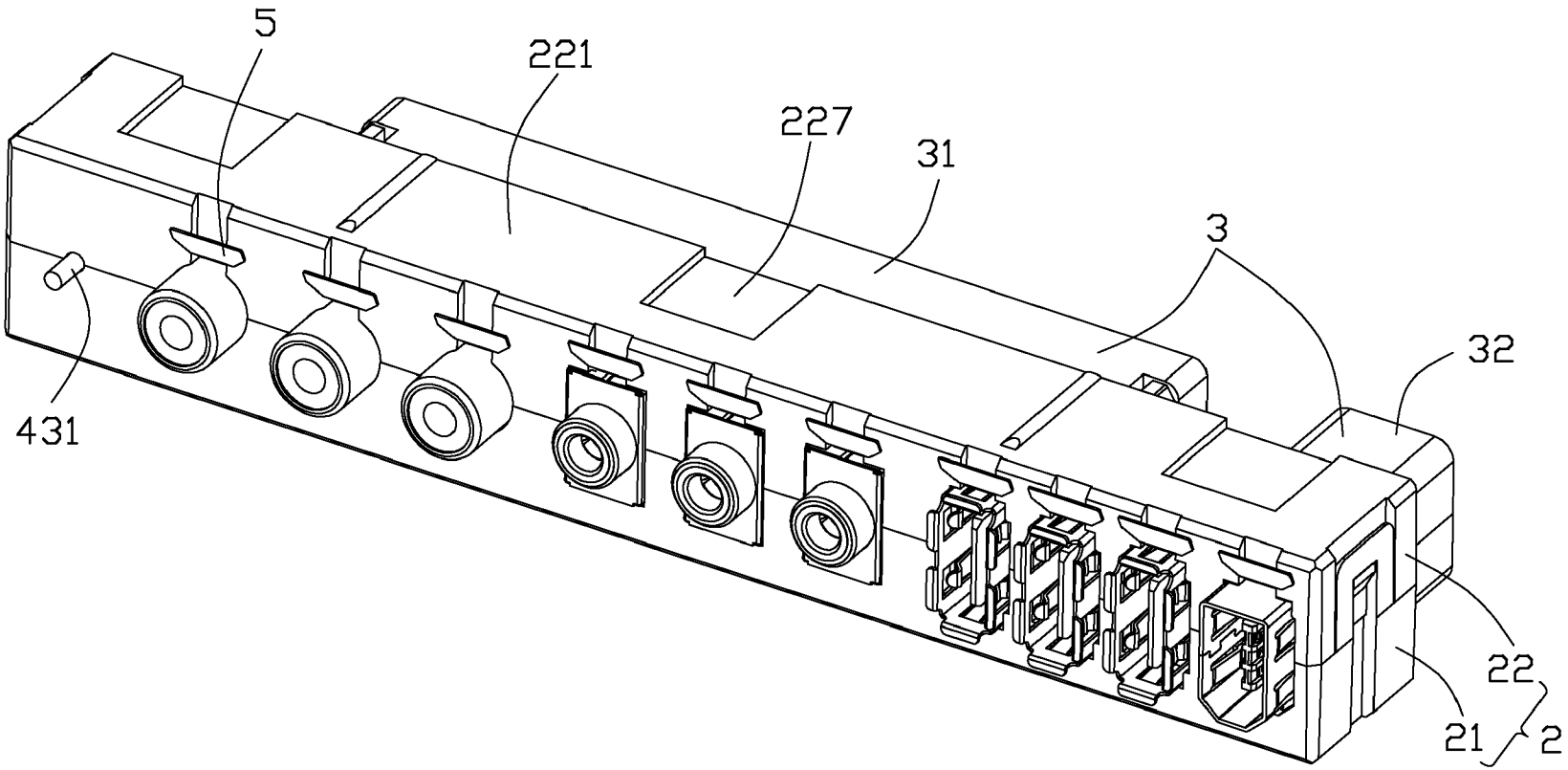
FIG. 4 is an assembled, perspective view of the cable assembly.

Reference will now be made in detail to the preferred embodiment of the present invention.

Referring to FIGS. 1-4, a cable assembly 100 in accordance with the present invention includes a number of different connectors 1, a cover 2 for accommodating the connectors 1, a cable holder 3 extending backwardly from the cover 2 and a switch device 4 accommodated in the cover 2. The connectors 1 and the switch device 4 are arranged in a row along a horizontal direction.

The connectors 1 includes three RCA connectors 12, three Audio connectors 13, three USB connectors 14, a IEEE 1394 connector 15, all of which arranged in a row along a transversal direction. Those connectors 1 have similar structure or configuration, although different connectors have different shape/contour. Take one of the USB connectors 14 as an example, it has a contact seat 14 for retaining corresponding contacts (not numbered), a metallic shielding member 142 enclosing the contact seat 14 therein and a mating port 143 formed at a front end of the shielding member 142.

The cover 2 includes a first (lower) cover 21 and a second (upper) cover 22. The first cover 21 has a first base portion 211 and two first side walls 212, 213 extending upwardly from two lateral edges of the first base portion 211, a first front wall 214 and a first back wall 215 extending upwardly from a front and back edges of the first base portion 211 and further joining with the two first side walls 212, 213, therefore a first receiving space 210 is formed by the first base portion 211, the first front wall 214, the first back wall 2154 and the two first side walls 212, 213. A pair of clasps 2121, 2122 project upwardly from the two first lateral walls 212, 213 respectively. Two locking slots 2122, 2132 are defined in the pair of clasp 2121, 2122, respectively. A number of first openings 2141 are defined in the first front wall 214 for allowing the mating ports of the connectors 1 exposed outward via therein. There are some positioning posts **3*a* located in the first receiving space 210. A number of first retaining slots 216 are arranged in the first receiving space 210 and proximate to the first front wall 214. Each first retaining slot 216 is formed by a front vertical wall 2161 and two lateral vertical walls 2162 located at opposite sides of the front vertical wall 2161**.

The second cover 22 has a second base portion 221 and two second side walls 222, 223 extending upwardly from two lateral edges of the second base portion 221, a second front wall 224 and a second back wall 225 extending upwardly from a front and back edges of the second base portion 221 and further joining with the two second side walls 222, 223, therefore a second receiving space 220 is formed by the second base portion 221, the second front wall 224, the second back wall 225 and the two second side walls 222, 223. Two depressions 2222 are defined in the two second side walls 222, 223, respectively. A protrusion 2221 is formed in each depression 2222. The protrusion 2221 is adapted for latching with the clasp 2121/2131. A number of second openings 2241 are defined in the second front wall 224 and align with corresponding first opening 2241 along a vertical direction. There are some positioning cavities **3*b* located in the second receiving space 220, and each positioning cavity 3*b* has a number of crushing ribs 3*c* formed in an interior thereof. The positioning cavities 3*b* are adapted for engaging with the positioning posts 3*a*. A number of second retaining slots 226 are arranged in the second receiving space 220 and proximate to the second front wall 224**.

The cable holder 3 includes a first holder 31 and a second holder 32 spaced from each other along the transversal direction and connected with the cover 2. The first holder 31 includes a first lower part 311 and a first upper part 312. The first lower part 311 defines a number of wire groove 3111, and the second upper part 312 also defines a number of wire grooves 3121 aligning with the wire grooves 3111 along the vertical direction, respectively. Furthermore, two latching members 3112 are arranged at opposite sides of the first lower part 311, and two latching cavities 3122 are defined at opposite sides of the first upper part 312 to receive the two latching members 3112. The second holder 32 includes a second lower part 321 and a second upper part 322. The second lower part 321 defines a number of wire grooves 3211, and the second upper part 322 also defines a number of wire grooves 3221 aligning with the wire grooves 3211 along the vertical direction, respectively.

Figure 5:
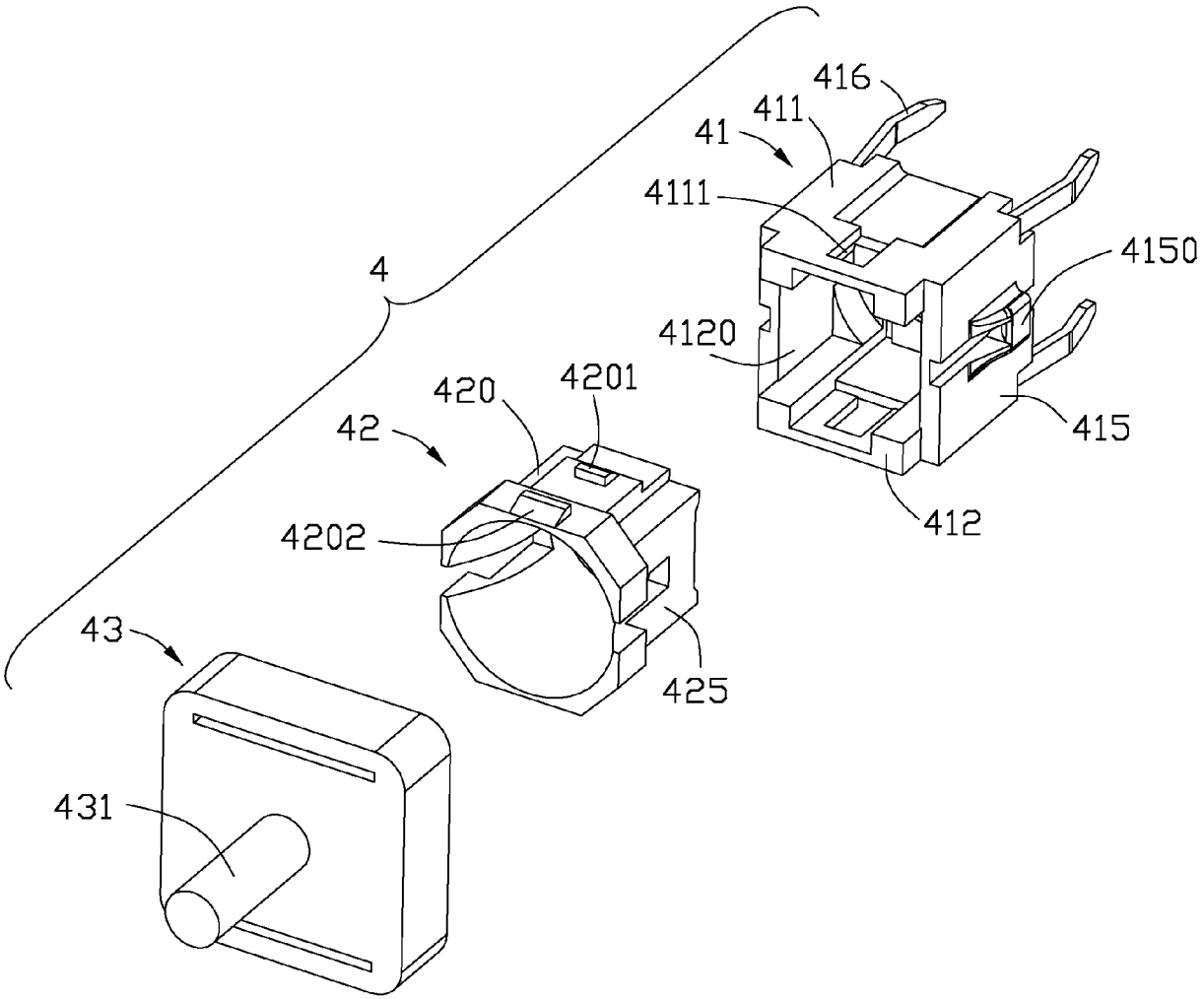
FIG. 5 is an exploded, perspective view of a switch device in the cable assembly.
Figure 6:
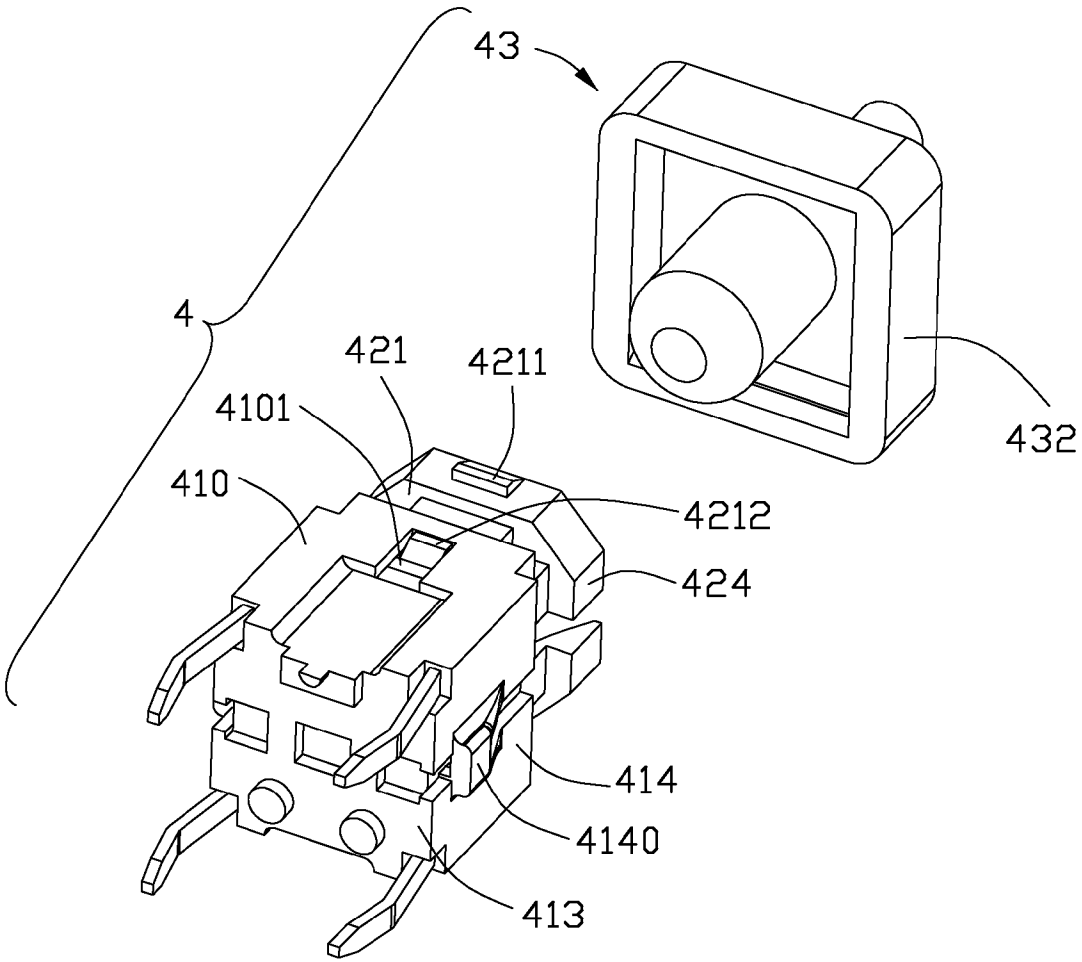
FIG. 6 is a partially assembled, perspective view of the switch device.
Figure 7:
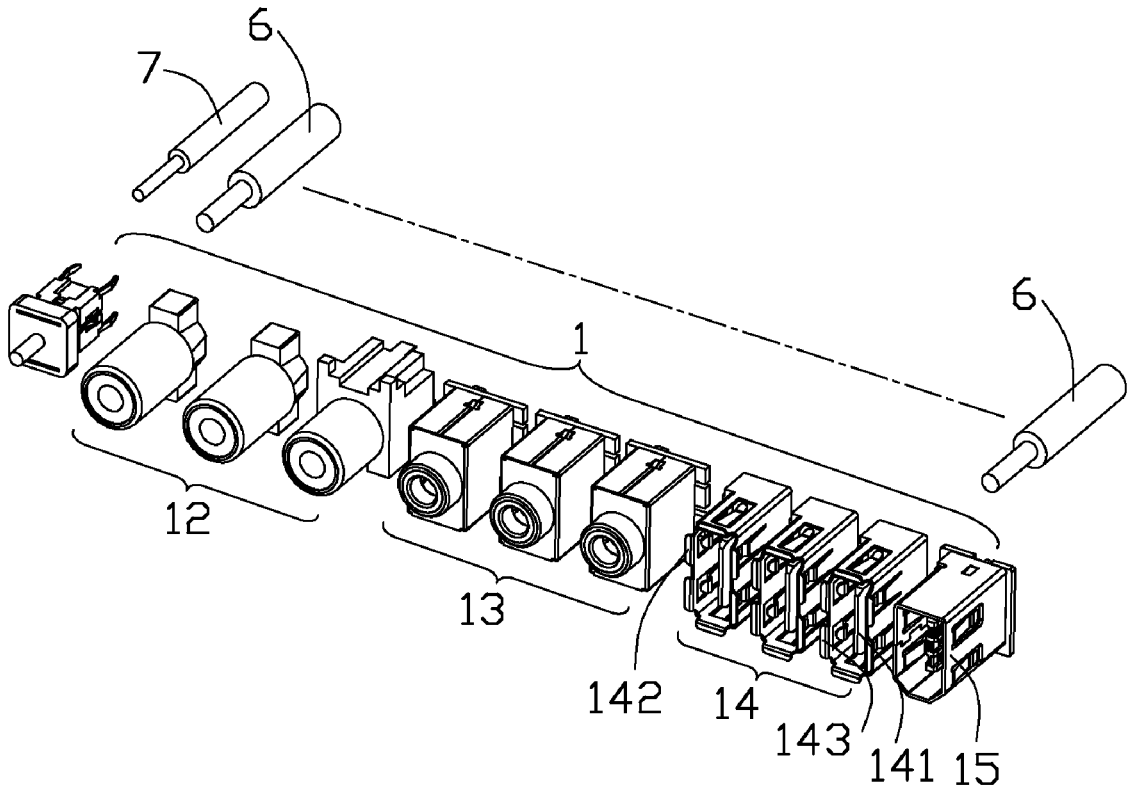
FIG. 7 shows relation between the switch device and corresponding wire, and the relation between connectors and corresponding cables.

Referring to FIGS. 5-6, the switch device 4 includes a base portion 41, a pushing portion 42 and an operating portion 43 assembled together along the front-to-back direction in sequence/in serial manner.

The base portion 41 includes a bottom wall 410, a top wall 411, a front wall 412, a back wall 413 and two side walls 414, 415 joining with the bottom wall 410, the top wall 411, the front wall 412 and the back wall 413. A receiving space 4120 is enclosed by the bottom wall 411, the top wall 411, the front wall 412, the back wall 413 and the two side walls 414, 415. Two locking holes 4101, 4111 are respectively defined in front portions of the bottom wall 410 and the top wall 411. In addition, two protrusions 4140, 4150 respectively protrude outwardly from back portions of the two side walls 414, 415. Four terminals 416 are mounted to four corners of the back wall 413, and those terminals 416 are adopted for connecting with a corresponding wire 7.

The pushing portion 42 includes a top side 420, a bottom side 421, a left side 424 and a right side 425 interconnected with each other to form a hollow (not numbered). A first wedged protrusion 4201 and a second wedged protrusion 4202 are respectively formed on a peripheral of the top side 420. The first wedged protrusion 4201 and the second wedged protrusion 4202 are spaced apart from each other along the front-to-back direction. In addition, a third wedged protrusion 4211 and a fourth wedged protrusion 4212 are respectively formed on the bottom side 421. The third wedged protrusion 4211 aligns with the second wedged protrusion 4202 along a up-to-down direction, and the fourth wedged protrusion 4212 aligns with the first wedged protrusion 4201 along the up-to-side direction. Furthermore, there are two slots (not numbered) are defined in front segments of the left side 424 and the right side 425, and such configuration may make front segments of the top side 420 and the bottom side 421 deformable/shrinkable along the up-to-down direction.

The operating portion 43 includes a cap 432 and a rod 431 mounted to the cap 432. The rod 431 includes a cylindrical shaped front part (not numbered) forwardly extends outward of the cap 432 via a corresponding hole (not numbered) and a cylindrical shaped rear part (not numbered) connecting with the front part and disposed behind the cap 432. The rear part of the rod 431 is thicker/large than the front part thereof.

The pushing portion 42 is assembled to the base portion 41, with a rear part of the pushing portion 42 accommodated in the receiving space 4120 of the base portion 41. The first wedged protrusion 4201 is locked into the locking hole 4111, and the fourth wedged protrusion 4212 is locked into the locking hole 4101. The operating portion 43 is assembled to the pushing portion 42, with the rear part of the rod 431 accommodated in the hollow of the pushing portion 42. The front part of the pushing portion 42 is received in an interior of the cap 43, with the second wedged protrusion 4202 and the third wedged protrusion 4211 engaging with the cap 43.

When assembling, the RCA connectors 12, the Audio connectors 13, the three USB connectors 14 and the IEEE 1394 connector 15 may be connected to corresponding cables 6. Then grounding tabs 5 are put into corresponding cavities 230 which are located in front of the second retaining slots 226 and defined in the second base portion 221 of the second cover 22. And then the aforementioned connectors are put into the second retaining slots 226. The metallic shielding member 142 of each connector further contacts with a corresponding grounding member 5. The switch device 4 is mounted to the second retaining slot 226 which is located at left side of the second cover 226. The first cover 21 is assembled to the second cover 22 along the up-to-down direction. The cap 432 is sandwiched between the front vertical wall 2161 and the first front wall 214, while the two protrusions 4140, 4150 of the base portion 41 are located behind the lateral vertical walls 2162, and the front part of the rod 431 forwardly extend outward via a holes defined in the first front wall 214 and the second front wall 224. The connectors 1 protrude outward via openings formed between the first openings 2141 and the second opening 2241. The connectors and the switch are all integrated together within the cover for easy assembling them to the cage of the computer by one step, no additional step is required to mount the switch to the computer, as conventional design aforementioned in Description of Related Art.

What is claimed is:

1. A cable assembly, comprising:

a cover having a plurality of retaining slots arranged in a row along a transversal direction;

a number of connectors mounted to the retaining slots, respectively; and a switch device mounted to the cover, the switch device including a base portion, a pushing portion and an operating portion assembled together in serial manner;

wherein the pushing portion has a rear part accommodated in the base portion and a front part accommodated in the operating portion;

wherein the operating portion includes a cap and a rod assembled to the cap;

wherein the rod includes a front part forwardly extends outward of the cap via a corresponding hole in the cap and a rear part connecting with the front part and disposed behind the cap;

wherein the rear part of the rod is thicker than the front part thereof.

2. The cable assembly as claimed in claim 1, wherein the rear part of the rod is accommodated in the pushing member.

3. The cable assembly as claimed in claim 1, wherein the cover includes a first cover and a second cover combined together to sandwich the connectors and the switch device therebetween.

4. The cable assembly as claimed in claim 1, wherein the switch device has four terminals extending outward from four corners of a back wall of the base portion.

5. The cable assembly as claimed in claim 1, wherein the switch device is arranged at left side of the connectors such that a user operates it conveniently.

6. The cable assembly as claimed in claim 1, wherein the pushing portion includes a top side, a bottom side, a left side and a right side interconnected with each other to form a hollow thereamong.

7. The cable assembly as claimed in claim 6, wherein two wedged protrusions are formed on back segments of the top side and the bottom side and locked into locking holes defined in an upper side and lower side of the base portion.

8. The cable assembly as claimed in claim 6, wherein either the left side or the right side defines a slot in the front part thereof.

9. The cable assembly as claimed in claim 8, wherein two wedged protrusions formed on front segments of the top side and the bottom side of the pushing portion and engage with interior of the cap.

10. The cable assembly as claimed in claim 1, wherein the cap is located in a front vertical wall of the retaining slot and a front wall of the cover.

11. The cable assembly as claimed in claim 10, wherein the base portion has two protrusions respectively protrude outwardly from back portions of two side walls thereof and are located behind the lateral vertical walls of the retaining slot.

* * * * *